United States Patent [19]

Barns

[11] 4,382,174

[45] May 3, 1983

[54] INFRA-RED HAIR DRYER

[75] Inventor: Ileana D. Barns, Riverside, Conn.

[73] Assignee: Clairol Incorporated, New York, N.Y.

[21] Appl. No.: 223,622

[22] Filed: Jan. 9, 1981

[51] Int. Cl.[3] ..... H05B 3/40; A45D 20/10

[52] U.S. Cl. ..... 219/370; 34/96; 219/373; 219/374; 219/368; 219/375

[58] Field of Search ..... 219/377, 374, 365, 375, 219/370, 373, 369, 343, 400, 368; 34/96-101

[56] References Cited

U.S. PATENT DOCUMENTS 3,289,679 12/1966 Zellerman ..... 34/99 X 3,888,018 6/1975 Gaski, Jr. ..... 34/99

4,323,761 4/1982 Hubner ..... 219/377

*Primary Examiner*—Roy N. Envall, Jr.

*Attorney, Agent, or Firm*—Isaac Jarkovsky; John J. Balser; Gerald S. Rosen

[57] ABSTRACT

There is disclosed a hand held pan shaped, infrared hair dryer containing a perforated air diffuser which can function as an infrared reflector if the air diffuser is shiny. The air diffuser also protects a quartz tube infrared emitter. A fan rotated by a motor causes air to flow through the perforations in the air diffuser and out the air outlet in a uniform airflow. The perforations are patterned so the airflow is uniform and negative airflow is essentially avoided. The infrared radiation is emitted by a quartz tube containing a wire resistance heater.

5 Claims, 4 Drawing Figures

INFRA-RED HAIR DRYER

DESCRIPTION

BACKGROUND OF THE INVENTION

I. Field of the Invention

This invention relates to hand held infrared hair dryers. More particularly, this invention relates to such hair dryers having within a pan shaped housing, a low velocity axial fan between a perforated air diffuser and air inlet, also a quartz infrared radiation source shielded by and in front of the diffuser, between the diffuser and the air outlet. The pattern of the perforations prevents any substantial negative airflow.

II. Prior Art

Hand held infrared hair dryers are known. However, there are none which have an air diffuser which supports and shields the infrared source and substantially prevents negative airflow.

One such hand held infrared hair dryer is described in U.S. Pat. No. 4,323,761 issued Apr. 6, 1982. This hair dryer is pan shaped with a fan in the back part of the housing in an opening in an infrared reflector. The fan is driven by a motor in the front part of the housing. The reflector is circular and is provided with an opening in the center to allow the fan blades to turn. An annular infrared heating element is provided in front of the reflector to radiate heat past a front grill element. This hair dryer, while generally satisfactory does not have uniform airflow at the air outlet and has the disadvantage of negative airflow because some of the air returns into the front of the dryer causing uneven, inefficient heating of the hair.

Other radiant hair dryers are disclosed in the following patents:

Great Britain Pat. No. 924,139 issued Apr. 24, 1963; Meyer, U.S. Pat. No. 1,541,988 issued June 6, 1925; Martin, U.S. Pat. No. 1,961,722 issued June 5, 1934; Mauger, U.S. Pat. No. 1,006,767 issued Oct. 24, 1911 and Zellerman, U.S. Pat. No. 3,289,679 issued Dec. 6, 1966.

The use of perforated elements in hair dryers to allow airflow through the perforations is shown in Shelton, U.S. Pat. No. 1,760,997 issued June 30, 1930 and Riblett, U.S. Pat. No. 3,786,575 issued Jan. 22, 1974. The perforations, as depicted in these patents, are uniform in size and are not disclosed for the purpose of enhancing uniform airflow and preventing negative airflow. The Shelton and Riblett devices do not have a relatively large hole at the top of the perforated element because the fan blade is between that element and the motor. Thus these prior art devices did not have the same problem of very uneven airflow and negative airflow which are present in the hair dryers having a pan shaped housing.

Roys, U.S. Pat. No. 1,388,822 issued Aug. 23, 1921 discloses a heater having a perforated air diffuser. The perforations are largest near the outer periphery and smallest near the center. This results in negative airflow in the central area.

BRIEF SUMMARY OF THE INVENTION

The invention provides a hair dryer with a pan shaped housing. The housing has an air inlet in back and air outlet in front and an elongated handle extending from the circumferential periphery thereof. Inside the housing between the air inlet and air outlet is an axial fan attached to a motor. The motor is affixed to the housing between the fan and the air outlet. A perforated annular air diffuser attached to the housing at the perimeter is between the fan and air outlet. A circular ring shaped quartz tube containing a wire resistance heater therein is fixed to the diffuser on the air outlet side thereof and is shielded in a parabolic shape at the outside perimeter of the air diffuser. The quartz tube emits infrared radiation in the wavelengths which are absorbed by water. The perforations in the air diffuser vary in size in a pattern which ensures that the airflow caused by the fan is uniform and that there is essentially an absence of negative airflow and its attendant inefficient and uneven heating of hair. Thus the dryer of this invention heats the hair efficiently and evenly.

DETAILED DESCRIPTION

Figure 1:
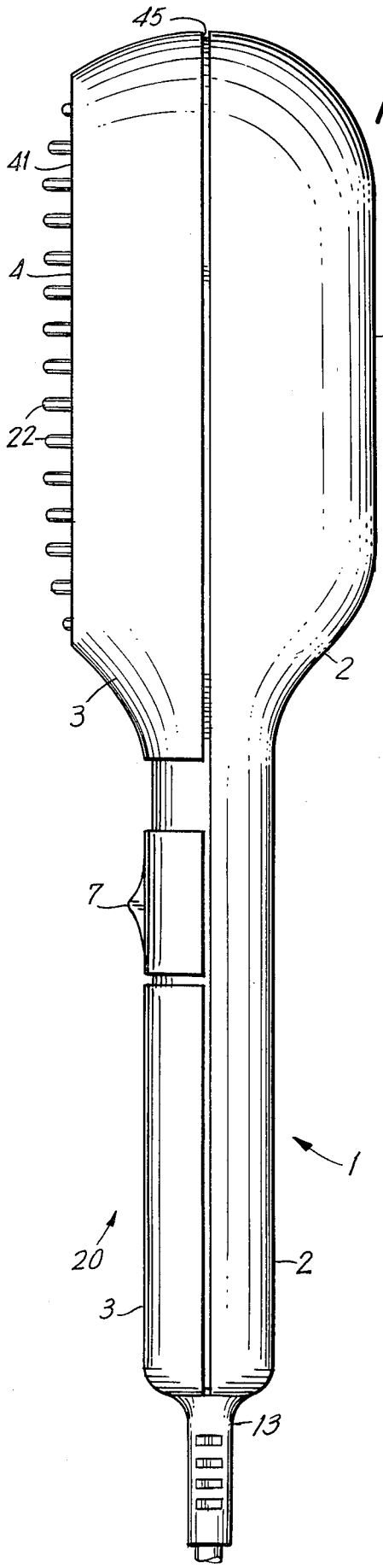
FIG. 1 is an elevational side view of the dryer of this invention.

With reference to FIGS. 1–4, the hair dryer 1 of this invention has the following elements: a pan shaped housing having an elongated handle 20 extending from the circumferential periphery thereof; an air inlet 5 and an air outlet 4; a fan motor 9 and an axial fan 8; an annular perforated air diffuser 11 and a ring shaped quartz tube 14 infrared radiation source shielded by and in front of the air diffuser 11. The housing, which is heat and impact resistant molded plastic, is formed from a rear housing 2 which has an air inlet 5 and a front housing 3 which has an air outlet 4. The front housing 3 and rear housing 2 are held firmly together at their perimeters by screws 6 in the handle portion 20 and locking tabs 40 in the peripheries of the circular portion of the rear housing 2 and the front housing 3. The air inlet 5 is a generally circular opening in the rear housing 2 having flush grids 23. A screen 10 is placed against the inner wall of the grids 23. The air outlet 4 is a generally circular opening in the front housing 3 with grids 22 extending outward and inward from the edge of the housing 41 forming the air outlet 4. The grids 22 may be highly polished metal, preferably aluminum, and are an integral part of circular ring 42 held in place in the front housing 3 by pairs of bosses 43 when lock the grid in place in a bayonet manner. The sides of the grids reflect the infrared radiation from the quartz tube 14 infrared emitter.

Inside the housing is a fan motor 9 whose axis extends from front to rear with respect to the housing. The fan motor 9 on the fan side is fixedly attached to the housing by four screws 19 in flanges 24. The motor 9 is a low RPM motor whose shaft 25 rotates at a speed of about 4,000 to 5,000 RPM, preferably about 4,500 RPM. The fan 8 is between the motor 9 and the air inlet 5.

Figure 2:
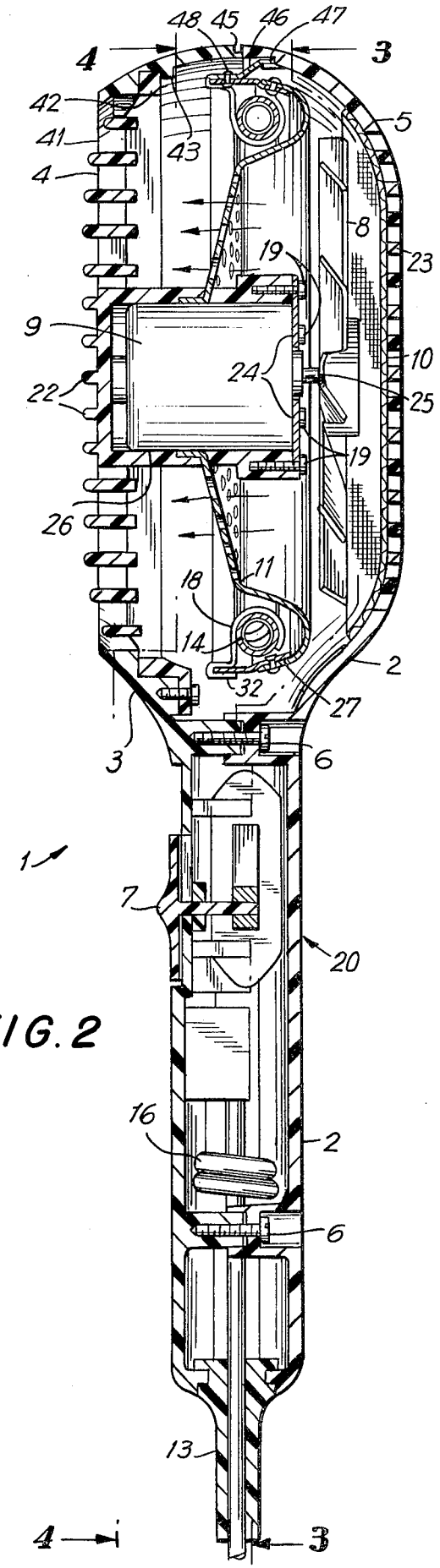
FIG. 2 is an elevational side view, in section of the dryer.
Figure 3:
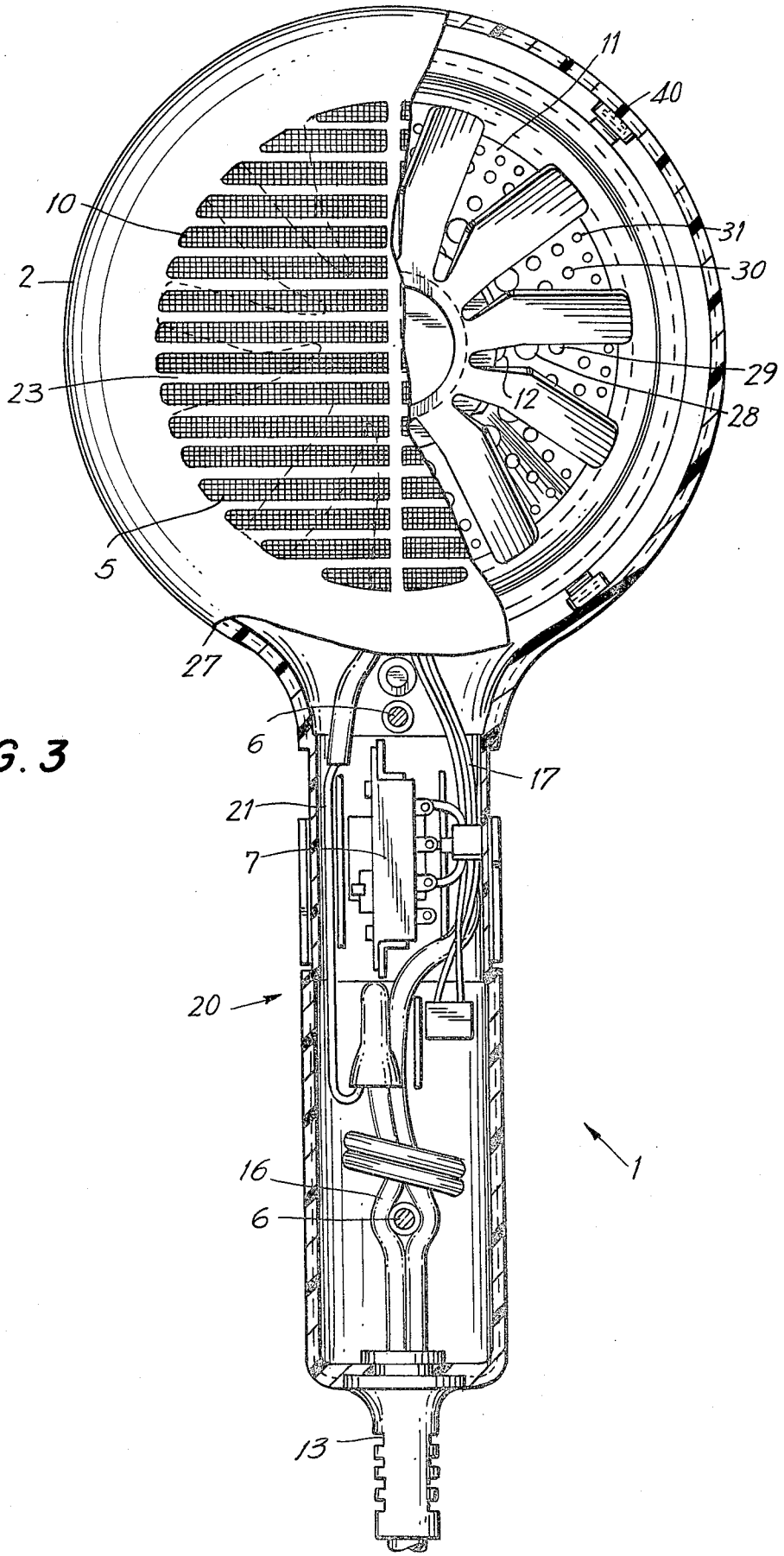
FIG. 3 is an elevational rear view in partial section of the dryer taken along line 3—3 of FIG. 2.
Figure 4:
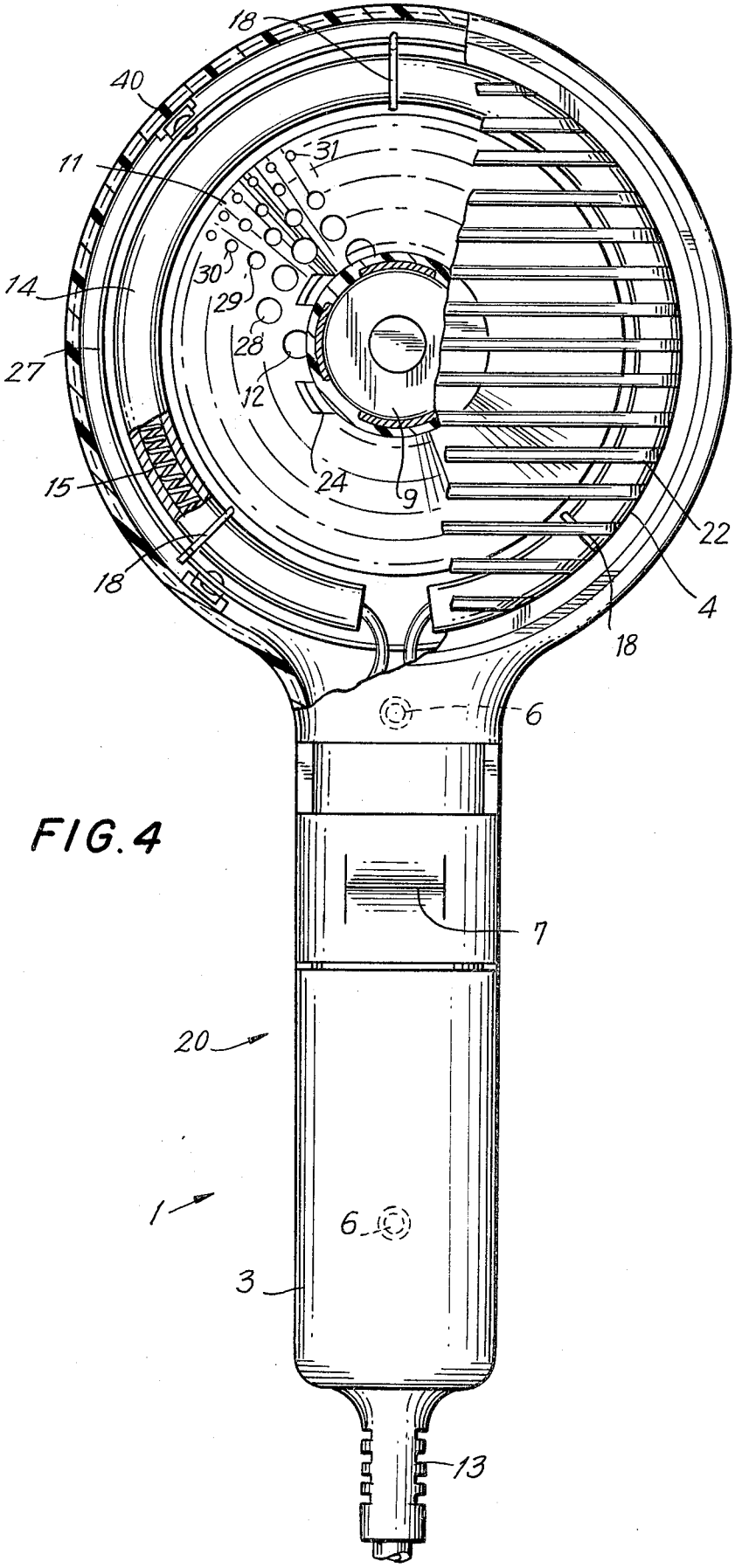
FIG. 4 is an elevational front view in partial section of the dryer taken along line 4—4 of FIG. 2.

Attached to the motor 9 and the housing at approximately the location of the seam 45 where the front housing 3 and the rear housing 2 are joined is an annular diffuser 11. The diffuser 11 extends toward the motor housing 26 at the diffuser 11 annulus at an acute angle from the seam line 45 toward air outlet 4 and is attached to the rear housing 2 e.g. by a spring 46 attached in a recess 47 in the rear housing perimeter and a connector 48 in the outer perimeter 27 of the diffuser 11. The spring 46 acts as a shock absorber if the dryer 1 is dropped, helping to avoid breakage of the quartz tube 14. The quartz tube holder 18 described below assists in preventing breakage. The air diffuser 11 is attached in the housing in a position relative to the fan 8 so the fan 8 is between the back of the air diffuser 11 and the air inlet 5. The air diffuser 11 in section resembles the shape of mirror image question marks separated by a space as seen in FIG. 2. Its perimeter diameter is less than the inside diameter of the housing with a space between the perimeter 27 of the air diffuser 11 and the inside housing diameter acting as an air passage so the air can cool the housing interior.

The air diffuser 11 is made of a metal, preferably aluminum. The surface of the air diffuser facing the air outlet 4 can be shiny to reflect all the infrared radiation emitted by the quartz tube 14 or it can be blackened either over the whole surface or in any desired pattern. For example, the portion of the air diffuser 11 shielding the quartz tube 14 can be shiny and reflect infrared radiation while the rest of the surface of the air diffuser 11 is blackened. In addition, the complete surface can be blackened to absorb the infrared radiation from the rear face of the quartz tube infrared emitter 14 and any reflected infrared radiation from the hair.

The air diffuser 11 has a pattern of holes or perforations in it which permit the airflow from the fan 8 to be uniform out of the air outlet 4. The airflow also cools the air diffuser 11 which is heated by the infrared radiation it absorbs, either when completely blackened when large amounts are absorbed or when partially blackened or shiny when lesser amounts are absorbed. A suitable hole pattern is one in which the holes are round and are in circular rows substantially parallel to the outside perimeter 27 of the diffuser 11. For example, a suitable pattern is one in which there are five circular rows of holes in which the circular row nearest the annulus contains eight evenly spaced holes 12 with diameters of about 0.218 inches each; the next larger row of perforations contains twenty-four evenly spaced holes 28 of about 0.187 inches in diameter; the third largest row contains thirty-six evenly spaced holes 29 of about 0.125 inches in diameter; the fourth largest row contains forty-eight evenly spaced holes 30 of about 0.093 inches in diameter; and the fifth largest row contains sixty evenly spaced holes 31 of about 0.062 inches in diameter. This particular pattern of holes is suitable for the diameter (about 4.5 inches) of the air diffuser 11, the speed of the fan 8, its capacity for moving air and the size of the air outlet 4. This results in a uniform flow of air from the holes, around the air diffuser 11 and out the air outlet 4 as shown by the arrows in FIG. 2. The holes act to diffuse the airflow to make it uniform when it is blown through the holes. If the holes were all the same size, then the airflow would be stronger at the perimeter causing turbulence and negative airflow. That is, some of the air would return to the dryer 1 through the air outlet 4.

Fixed to the air outlet 4 side of the air diffuser 11 is a ring shaped quartz tube 14 containing a wire heater 15. The quartz tube 14 emits infrared radiation when the wire heater 15 is heated. The emissions, from about 2–6 microns wavelength, are within the range which are absorbed by water. This causes water on the hair to heat and evaporate.

The quartz tube 14 is attached to the air diffuser 11 in the curved, preferably parabolic shaped, part by the curved holder 18 which supports the tube 14 in the curved part and is attached to the air diffuser 11 at a leg 32 extending from the curved portion. This type of holder for the quartz tube 14 enhances the ability of the tube 14 to resist breakage when the hairdryer 1 is dropped or jarred.

The handle portion 20 of the housing contains therein an on-off switch 7 and electric wiring to power the motor and wire heater.

An electric cord 13 which extends from the end of the handle 20 has a plug, not shown, which fits into an electrical receptacle. The portion of the cord 13 leading into the handle 20 at wire 16 is electrically connected to an on-off switch 7 which is in the front of the handle 20 in the top portion. Wires 17 and 21 respectively are electrically connected to the fan motor 9 and the heater 15 in the quartz tube 14.

In use the infrared hair dryer of this invention operates as follows.

The operator of user turns the on-off switch 7 to the "on" position causing the heater 15 to become hot and the quartz tube 14 to emit infrared rays which are reflected out the air outlet 4 by the air diffuser 11 or the front grids 22 depending on the character of the surface of the air diffuser 11, to the hair of the user, thereby drying it. At the same time, the fan motor 9 rotates the fan 8 thereby drawing air through the air inlet 5 past and through the air diffuser 11 and out the air outlet 4 as shown by the arrows in FIG. 2. The air cools the housing and the air diffuser 11 and also blows the evaporated water from the hair of the user. The low velocity of the airflow permits use of the dryer with hair which is set or has curls and which the user does not want to disturb while drying. When the hair is dry, the user turns the on-off switch 7 to the "off" position thereby turning off the fan motor 9 and the heater 15.

I claim:

1. A hand held electric hair dryer comprising:

a housing in the shape of a pan having an air inlet and an air outlet;

a low RPM fan motor fixed inside said housing between said air inlet and said air outlet;

an axial fan on the shaft of said motor between said air inlet and said motor;

an annular air diffuser facing the air outlet and fixed to said housing between said fan and said air outlet wherein the air diffuser has a multiplicity of circumferential rows of perforations, each row being a different diameter and having the perforations therein the same distance apart as the perforations in the other rows, the size of the perforations in the row with the largest diameter being smaller than the perforations in the other rows and the size of the perforations in the row with the smallest diameter being larger than the perforations in the other rows;

an annular infrared emitting quartz tube fixed to said air duffuser on the air outlet face thereof, said quartz tube having a heater therein, and electrical connecting means for powering said fan motor and said heater.

2. The hair dryer of claim 1 wherein the infrared emissions are from 2–6 microns wavelength.

3. The hair dryer of claim 1 wherein the perforations in the intermediate rows of said air diffuser are of increasing size in inverse proportion to the diameter of said row.

4. A hand held infrared emitting electric hair dryer having a housing in the shape of a pan having an elongated handle with an air inlet in the back of said circular pan portion and air outlet in the front of said circular pan portion, where inside of said housing are, from back to front, an axial fan attached to the shaft of a low RPM motor which is attached to the housing, an annular diffuser of blackened aluminum having five rows of perforations with the distance between perforations the same in all rows, each row having a different diameter and the perforations in each row being of a size inverse to the diameter of the row, said diffuser attached to the inside of the housing, the diameter of the perimeter of said air diffuser being smaller than the inside diameter of said housing, an infrared emitting ring shaped quartz tube fixed to said air diffuser and shielded by a curved portion thereof, and, in the handle portion of said housing, electrical connecting means to said heater and said fan motor for connecting to an electric power source.

5. The hair dryer of claim 4 wherein the infrared emitted from the quartz tube is from about 2–6 microns wavelength.

* * * * *